US010394178B2

(12) United States Patent
Fujinuma

(10) Patent No.: US 10,394,178 B2
(45) Date of Patent: Aug. 27, 2019

(54) SHEET FEEDING APPARATUS AND IMAGE FORMING APPARATUS

(71) Applicant: CANON KABUSHIKI KAISHA, Tokyo (JP)

(72) Inventor: Yasuhito Fujinuma, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/899,775

(22) Filed: Feb. 20, 2018

(65) Prior Publication Data

US 2018/0239295 A1 Aug. 23, 2018

(30) Foreign Application Priority Data

Feb. 21, 2017 (JP) ..... 2017-029612

(51) Int. Cl.

| | |
|---|---|
| ***B65H 1/14*** | (2006.01) |
| ***B65H 3/06*** | (2006.01) |
| ***G03G 15/00*** | (2006.01) |
| ***B65H 1/08*** | (2006.01) |

(Continued)

(52) U.S. Cl.

CPC ..... *G03G 15/70* (2013.01); *B65H 1/04* (2013.01); *B65H 1/08* (2013.01); *B65H 1/14* (2013.01); *B65H 3/0669* (2013.01); *B65H 3/0684* (2013.01); *B65H 7/02* (2013.01); *B65H 7/04* (2013.01); *B65H 7/14* (2013.01); *B65H 7/18* (2013.01); *G03G 15/6511* (2013.01); *B65H 2404/1521* (2013.01); *B65H 2511/417* (2013.01); *B65H 2511/512* (2013.01);

(Continued)

(58) Field of Classification Search

CPC ..... B65H 3/0684; B65H 1/14; B65H 1/18; B65H 7/02; B65H 7/04; B65H 7/14; B65H 7/18; B65H 7/20; B65H 2511/417; B65H 2404/1521

See application file for complete search history.

(56) References Cited

U.S. PATENT DOCUMENTS

| | | | | |
|---|---|---|---|---|
| 7,354,038 B2 * | 4/2008 | Watase | ..... | B65H 3/0615 271/10.12 |
| 7,971,868 B2 * | 7/2011 | Matsushima | ..... | B65H 1/14 271/117 |

(Continued)

FOREIGN PATENT DOCUMENTS

| | | | |
|---|---|---|---|
| JP | 11217127 A | * | 8/1999 |
| JP | 2005-247481 A | | 9/2005 |

(Continued)

*Primary Examiner* — Luis A Gonzalez
(74) *Attorney, Agent, or Firm* — Venable LLP

(57) ABSTRACT

A sheet feeding device includes a stacking unit for stacking a sheet; a feeding member for feeding the sheet stack on the stacking unit; a holding member holding the feeding member; a holder supporting portion, provided above the stacking unit, for detachably supporting the holding member; a raising and lowering unit for raising and lowering the holding member; a detection unit for detecting a topmost surface of the sheet stacked on the stacking unit, by detecting the holding member; a control unit for effecting raising and lowering operation of the holding member using the raising and lowering unit before a feeding operation of the feeding member and detect presence or absence of the holding member on the basis of a signal from the detection unit produced with the raising and lowering operation.

8 Claims, 6 Drawing Sheets

(51) Int. Cl.

| | |
|---|---|
| ***B65H 1/04*** | (2006.01) |
| ***B65H 7/14*** | (2006.01) |
| ***B65H 7/18*** | (2006.01) |
| ***B65H 7/04*** | (2006.01) |
| ***B65H 7/02*** | (2006.01) |

(52) U.S. Cl.
CPC .... *B65H 2513/412* (2013.01); *B65H 2601/26* (2013.01); *G03G 2215/00556* (2013.01)

(56) References Cited

U.S. PATENT DOCUMENTS

| | | | | |
|---|---|---|---|---|
| 8,430,393 | B2 * | 4/2013 | Matsushima | B65H 1/266 271/10.01 |
| 8,573,587 | B2 | 11/2013 | Yoshinaga | |
| 8,894,061 | B2 * | 11/2014 | Matsuoka | B65H 5/06 271/10.13 |
| 9,371,204 | B2 | 6/2016 | Inoue et al. | |
| 9,527,685 | B2 * | 12/2016 | Kawamura | B65H 3/0684 |
| 9,880,505 | B2 | 1/2018 | Matsumoto | |
| 2012/0326385 | A1 | 12/2012 | Yoshinaga | |
| 2014/0151954 | A1 | 6/2014 | Furusawa et al. | |
| 2017/0031295 | A1 | 2/2017 | Matsumoto | |
| 2017/0153589 | A1 * | 6/2017 | Sato | G03G 15/6529 |
| 2017/0217707 | A1 | 8/2017 | Fujinuma et al. | |
| 2018/0148285 | A1 * | 5/2018 | Suzuki | B65H 3/06 |

FOREIGN PATENT DOCUMENTS

| | | | |
|---|---|---|---|
| JP | 2011-136811 | A | 7/2011 |
| JP | 2013-001556 | A | 1/2013 |
| JP | 2017-030914 | A | 2/2017 |

* cited by examiner

SHEET FEEDING APPARATUS AND IMAGE FORMING APPARATUS

FIELD OF THE INVENTION AND RELATED ART

The present invention relates to a sheet feeding apparatus for feeding a sheet of recording medium into the main assembly of an image forming apparatus. It relates also to an image forming apparatus equipped with a sheet-feeding apparatus.

Generally speaking, an image forming apparatus such as a printing machine, a copying machine, a facsimile machine, etc., is equipped with a sheet feeding apparatus for feeding a sheet of recording medium into the main assembly of an image forming apparatus, and then, supplying the sheet to the image forming portion of the image forming apparatus. The sheet storing portion of a sheet feeding apparatus of this type is provided with a sheet holding portion on which multiple sheets of recording medium are loaded in layers. Further, it is structured so that the sheet holding portion can be raised to move the topmost sheet on the sheet holding portion into a position from which the sheet can be fed into the main assembly of the image forming apparatus. Further, it is provided with a sheet feeding-conveying portion (pickup roller), which is placed in contact with the top surface of the topmost sheet of recording medium on the sheet holding portion to send the topmost sheet toward the image forming portion. Moreover, in order to make it easier for a user of an image forming apparatus to place a stack of sheets of recording medium into the sheet storing portion of an image forming apparatus, a sheet feeding apparatus of this type is structured so that its sheet storing portion can be pulled out of the main assembly of the image forming apparatus, and also, so that as the sheet storing portion is pulled out of the main assembly, the sheet holding portion is lowered to a preset sheet mounting position.

Further, a sheet feeding apparatus of this type is structured so that after the placement of a stack of sheets of recording medium on the sheet holding portion, the sheet holding portion is automatically raised, by the driving force from a mechanical power source, such as an electric motor. As the sheet holding portion on which the stack of sheets of recording medium is present is raised, the top surface of the topmost sheet of recording medium on the sheet holding portion comes into the sheet feeding-conveying portion, and then, causes the sheet feeding-conveying portion to upwardly pivot. Consequently, a flag, with which the holding member for holding the sheet feeding-conveying portion is provided, is detected by a sensor positioned on the top side of the sheet feeding-conveying portion, enabling the control portion of the image forming apparatus to detect the position of the sheet feeding-conveying portion, based on the signal outputted by the sensor. Then, the control portion turns off the power source in response to the flag detection signals from the sensor, to position the sheet holding portion so that the topmost sheet of recording medium on the sheet holding portion can be fed into the main assembly of the image forming apparatus. That is, the image forming apparatus is structured so that the topmost sheet of recording medium on the sheet holding portion is positioned to be fed into the main assembly of an image forming apparatus, and then, is conveyed further into the main assembly, based on the position (angle) of the sheet feeding-conveying portion. Therefore, even if some of the sheets of recording medium on the sheet holding portion are floating (not tightly stacked), and/or not flat, the topmost sheet of recording medium can be properly positioned to enable the sheet feeding-conveying portion to properly feed and convey the topmost sheet. Thus, it is possible to enable the sheet feeding-conveying portion to precisely feed (pick up) and convey the topmost sheet.

However, a conventional sheet feeding-conveying portion structured as described above suffers from the following problem. That is, if the holding member for holding the sheet feeding-conveying portion is not disposed, or is improperly disposed, in the sheet feeding apparatus, for example, if a user forgot to reattach the holding member after the user removed the sheet holding member to replace the sheet feeding-conveying portion (pickup roller), the following problem occurs. Without the presence of the holding member, there is no flag to be detected by the sensor for stopping the upward pivoting of the sheet holding portion. Thus, the sensor does not output a flag detection signal. Therefore, the power source is not stopped. Consequently, the sheet holding portion is moved upward further than expected, making it possible that the holding member and/or the structural members, which will be in the adjacencies of the sheet feeding-conveying portion if the sheet feeding-conveying portion is present, will be damaged. Moreover, even if the damages are avoided, the following problem occurs. That is, if a printing operation is started without the presence of the holding member, no sheet of recording medium is fed into the main assembly, and therefore, the control portion determines that a paper jam or the like has occurred. In this case, however, it is rather difficult for a user to realize that no paper jam has occurred, and the real problem is that the user forgot to reattach the holding member.

SUMMARY OF THE INVENTION

According to an aspect of the present invention, there is provided a sheet feeding device comprising a stacking unit configured to stack a sheet; a feeding member configured to feed the sheet stack on said stacking unit; a holding member holding said feeding member; a holder supporting portion provided above said stacking unit and configured to detachably support said holding member; a raising and lowering unit configured to raise and lower said holding member; a detection unit configured to detect a topmost surface of the sheet stacked on said stacking unit, by detecting said holding member; a control unit configured to effect raising and lowering operation of said holding member using said raising and lowering unit before a feeding operation of said feeding member and detect presence or absence of said holding member on the basis of a signal from said detection unit produced with the raising and lowering operation.

Thus, the object of the present invention is to provide a sheet feeding apparatus structured so that it can determine whether or not its holding member is properly disposed, before a sheet of recording medium begins to be fed into the main assembly of an image forming apparatus, and also, to provide an image forming apparatus equipped with the sheet feeding apparatus which is in accordance with the present invention.

Further features of the present invention will become apparent from the following description of exemplary embodiments (with reference to the attached drawings).

Figure 4:
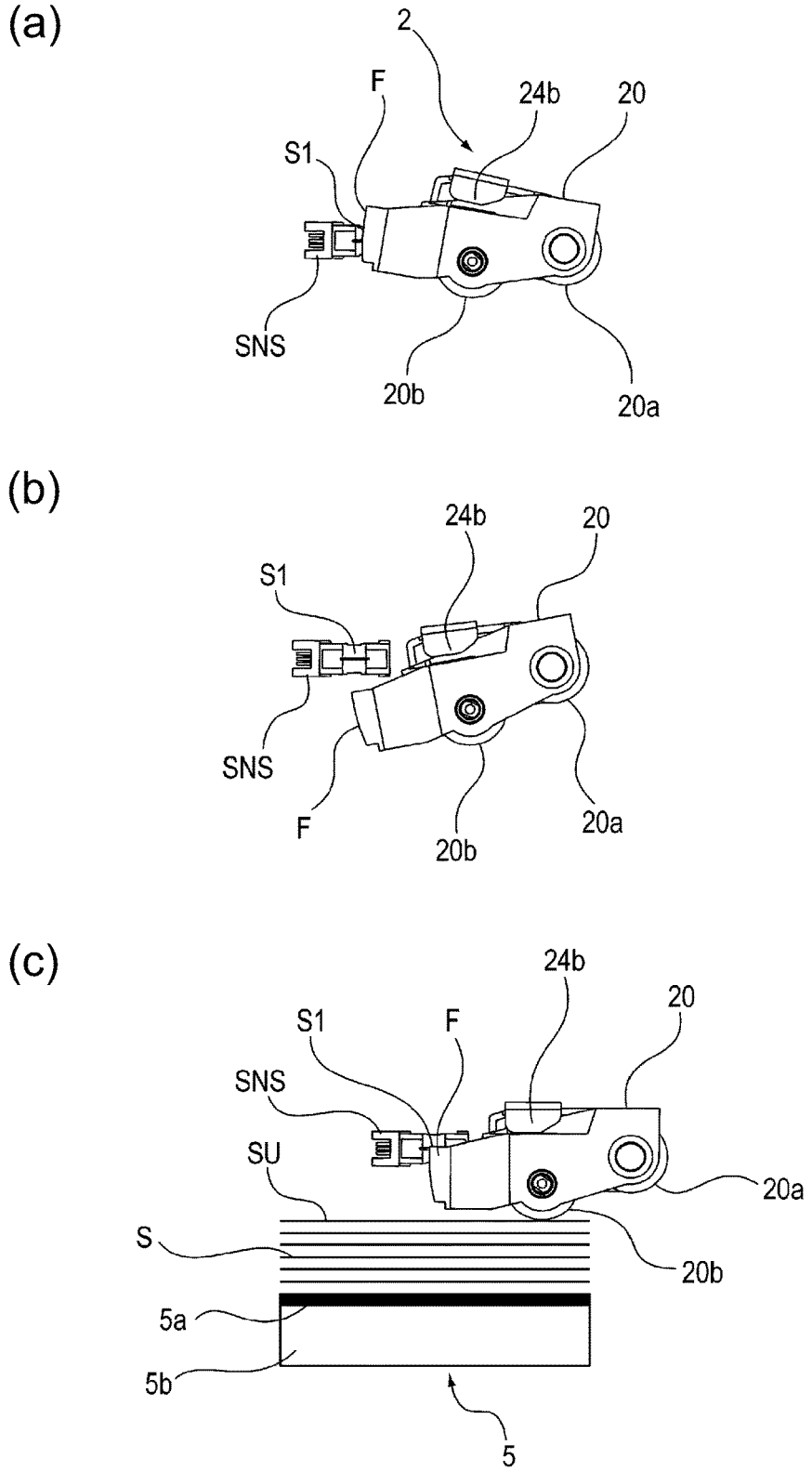

Part (a) of FIG. 4 is a side view of the sheet feeding-conveying portion of the sheet feeding apparatus in the first embodiment, when the flag of the holding member of the apparatus is blocking the beam of light emitted by the light emitting portion of the sheet sensor of the sheet feeding apparatus; part (b) of FIG. 4, when the flag is in its lowest position; and part (c) of FIG. 4 is a side view of a combination of the sheet feeding-conveying portion of the sheet feeding apparatus in the first embodiment, sheet holding portion, and a stack of sheets of recording medium on the sheet holding portion, when the sheet feeding-conveying portion is in contact with the topmost sheet of recording medium on the sheet holding portion. They are for showing and describing the upward and downward pivotal movement of the sheet feeding-conveying portion.

Figure 5:
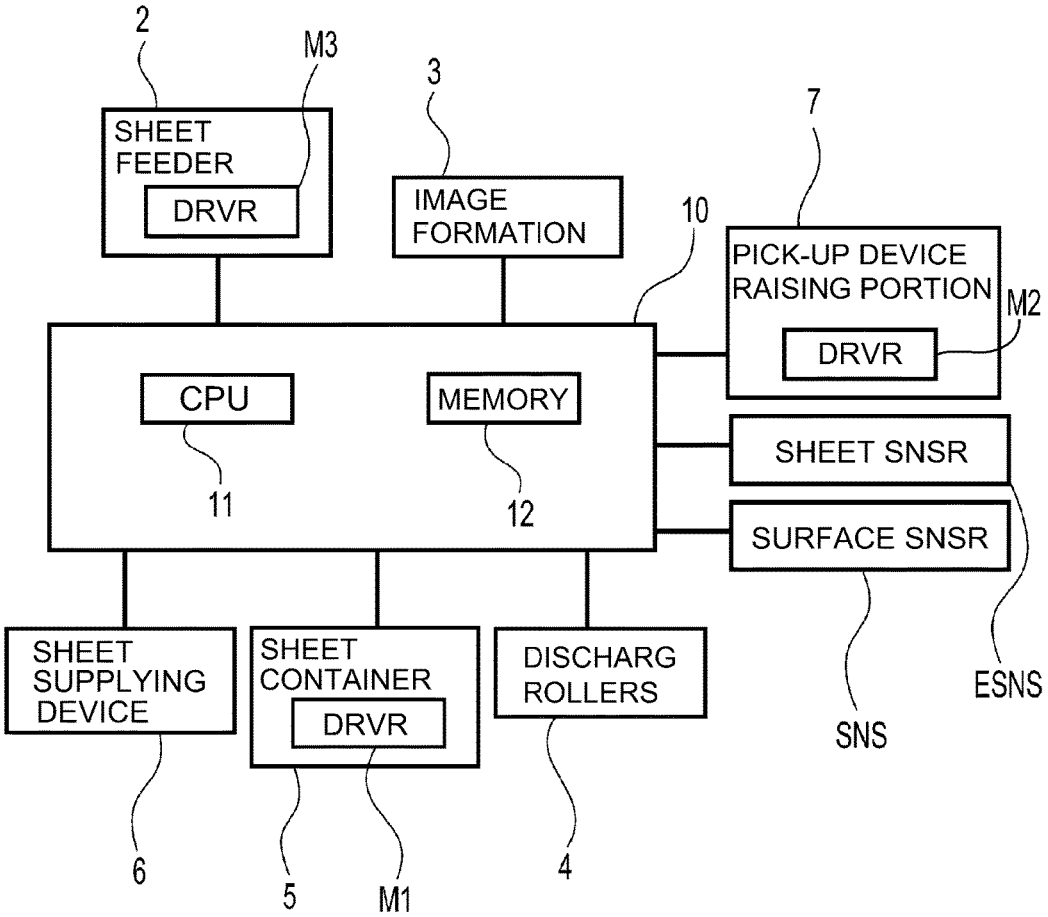

FIG. 5 is a block diagram of the control portion of the printer in the first embodiment, which is for describing the control portion.

Figure 6:
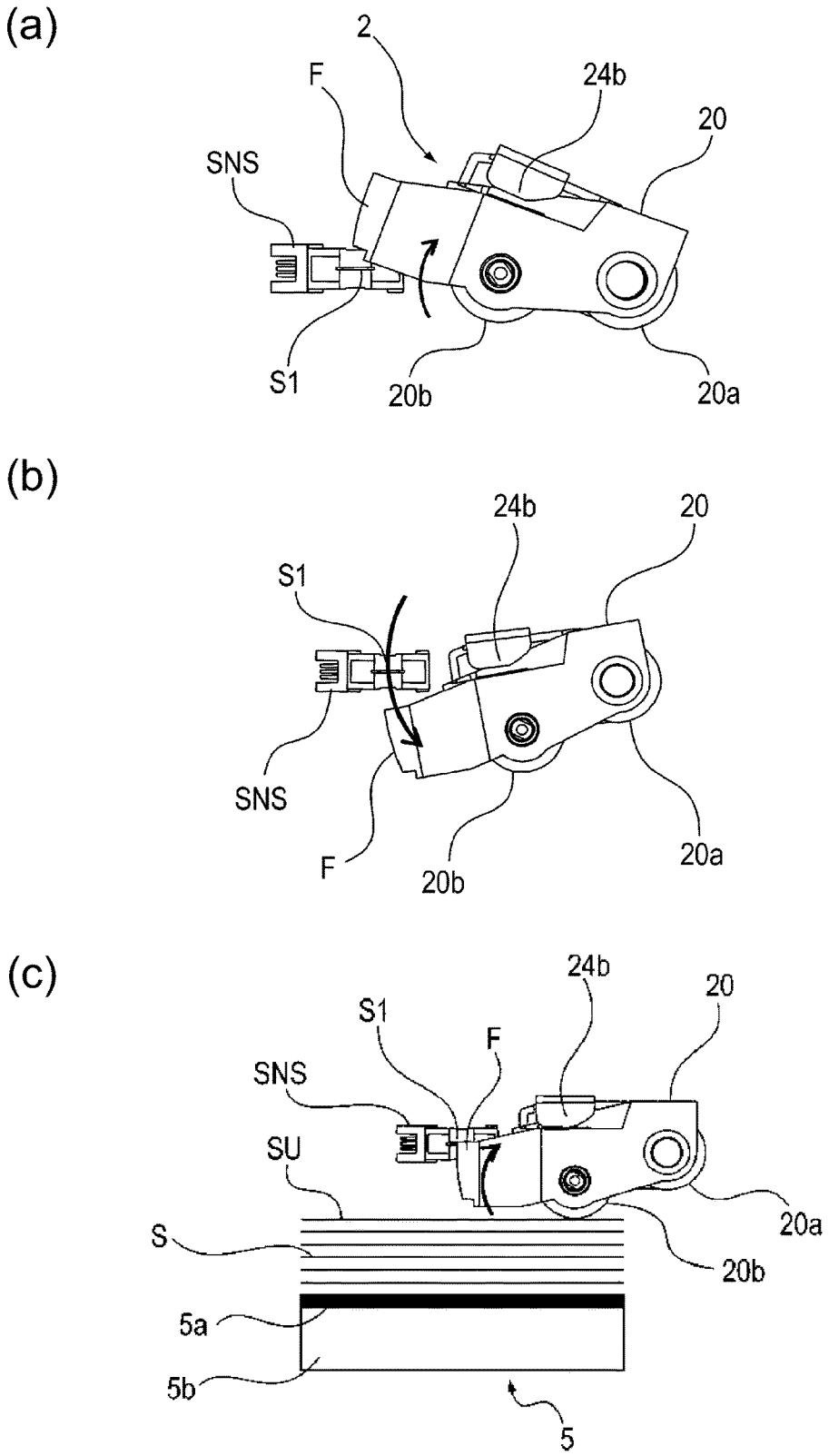

Part (a) of FIG. 6 is a side view of the sheet feeding-conveying portion of the sheet feeding apparatus in the second embodiment of the present invention when the flag of the holding member of the apparatus is above the path of the beam of light emitted by the light emitting portion of the sheet sensor of the sheet feeding apparatus; part (b) of FIG. 6, when the flag is below the path of the beam; and part (c) of FIG. 6 is a side view of a combination of the sheet feeding-conveying portion of the sheet feeding apparatus in the first embodiment, sheet holding portion, and a stack of sheets of recording medium on the sheet holding portion, when the feed roller of the sheet feeding-conveying portion is in contact with the topmost sheet of recording medium on the sheet holding portion. They are for showing the structure of the sheet feeding-conveying portion.

DESCRIPTION OF THE EMBODIMENTS

Hereinafter, the present invention is described in detail with reference to a couple of preferred embodiments of the present invention. However, these embodiments are not intended to limit the present invention in scope in terms of the measurements, materials, and shapes of the structural members of the apparatus, and the positional relationship among the members. That is, the present invention is also applicable to various sheet feeding apparatuses modified according to the structure of an apparatus by which the sheet feeding apparatus is employed, and also, the conditions under which they are used.

[Embodiment 1]

To begin with, an image forming apparatus equipped with the sheet feeding-conveying portion (apparatus) in the first embodiment of the present invention is described referring to the appended drawings. The image forming apparatus in this embodiment may be such an image forming apparatus as a copying machine, a printing machine, a facsimile machine, a multifunction image forming machine capable of functioning as two or more of the preceding machines, etc. In the following description of the present invention, the image forming apparatus is described as an electrophotographic laser printer (which may be referred to simply as "printer").

Figure 1:
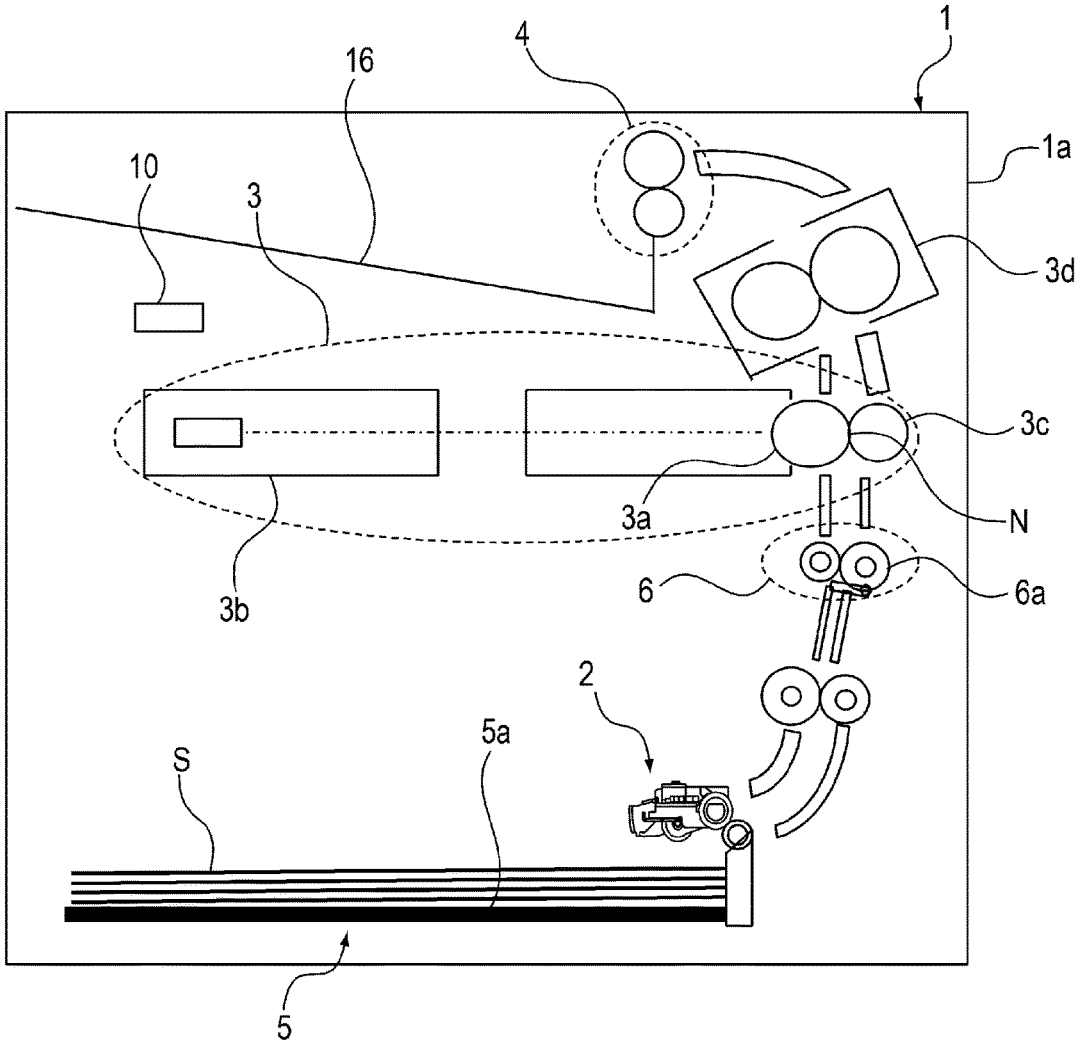
FIG. 1 is a schematic sectional view of the printer in the first embodiment of the present invention.

Referring to FIG. 1, the printer 1 in the first embodiment is described. First, referring to FIGS. 1 and 5, the printer 1 is described about its general structure. FIG. 1 is a schematic sectional view of the printer 1 in this embodiment. FIG. 5 is a block diagram of the control portion 10 of the printer 1 in this embodiment. It is for showing the structure of the control portion 10.

Referring to FIG. 1, the printer 1 has a main assembly 1*a*. The main assembly 1*a* has: a sheet feeding-conveying portion 2 for feeding a sheet of recording medium into the main assembly 1*a*, and for supplying the sheet further into the main assembly 1*a*; and a sheet storing portion 5 which is removably installable in the main assembly 1*a*, and in which multiple sheets of recording medium are storable in layers. The sheet storing portion 5 is provided with a sheet tray 5*a* in which multiple sheets S of recording medium can be stored in layers, and a tray raising portion 5*b* which raises the sheet tray 5*a*. Further, the main assembly 1*a* has: a sheet supplying portion 6 for supplying a sheet S of recording medium further into the main assembly 1*a* as the sheet S is fed into the main assembly 1*a*; an image forming portion 3 for forming an image on the sheet S of recording medium conveyed thereto by the sheet supplying portion 6; and a pair of discharge rollers 4 for discharging the sheet S into the sheet delivery portion 16. It has also a control portion 10 (control unit) for controlling the sheet feeding-conveying portion 2, sheet supplying portion 6, image forming portion 3, pair of discharge rollers 4, etc. By the way, the sheet tray 5*a* is a part of the unit in which multiple sheets S of recording medium are loadable in layers.

The sheet feeding-conveying portion 2 separates the topmost sheet S of recording medium from the rest, and conveys the sheet S to the sheet supplying portion 6 (sheet feeding apparatus 2), which will be described later in detail. If the sheet S is delivered askew to the sheet supplying portion 6, it is corrected in attitude by the sheet supplying portion 6. Then, it is conveyed to the image forming portion 3, which has: a photosensitive drum 3*a* as an image bearing member; an exposing apparatus 3 which projects a beam of laser light upon the photosensitive drum 3*a*; a transfer roller 3*c* which transfers a toner image onto a sheet S of recording medium; and a fixing portion 3*d* which fixes the toner image on the sheet S. Referring to FIG. 5, the control portion 10 has: a CPU 11 which drives, while controlling, the sheet feeding-conveying portion 2, image forming portion 3, pair of discharge rollers 4, sheet storing portion 5, sheet supplying portion 6, pick-up device raising portion 7, etc.; and a memory 12 in which various programs, etc., are stored. To the control portion 10, signals are inputted from various sensors such as a sheet surface detection sensor SNS, a sheet presence (absence) detection sensor ESN, etc. Based on these signals and the signals from external apparatuses, the control portion 10 controls the abovementioned portions of the printer 1 to ensure that the portions operate as designed.

Next, the control of the image formation process by the printer 1 (image formation control by control portion 10) is described with regard to mainly the structural members of the printer 1 described above. An image forming sequence by the printer 1 is started by the control portion 10 in response to the signals which reflect the information about the image to be formed, and which are sent from an unshown personal computer, a scanner, or the like. As the image forming operation is started, the exposing apparatus 3*b* projects a beam of laser light upon the peripheral surface of the photosensitive drum 3*a* while modulating the beam with the signals. Thus, the peripheral surface of the photosensitive drum 3*a*, which has just been charged to preset polarity and potential level, is exposed. Consequently, an electrostatic latent image is effected on the peripheral surface of the photosensitive drum 3*a*. This electrostatic latent image is developed by the unshown developing portion of the printer 1, into a visible image, that is, an image formed of toner (which hereafter will be referred to simply as toner image).

While a toner image is formed as described above, the sheet feeding-conveying portion 2 feeds sheets S of recording medium one by one into the main assembly 1*a* of the printer 1, while separating each sheet S from the rest. Then, each sheet S is conveyed to a pair of registration rollers 6*a* of the sheet supplying portion 6, which is disposed on the downstream side of the sheet feeding-conveying portion 2. Next, the sheet S is conveyed from the pair of registration rollers 6*a* to the transfer nip N, which is a nip formed between the photosensitive drum 3*a* and transfer roller 3*c*. Then, the sheet S is conveyed through the transfer nip N. While the sheet S is conveyed through the transfer nip N, the toner image formed on the peripheral surface of the photosensitive drum 3*a* is transferred onto the sheet S. Then, the sheet S is conveyed to the fixing portion 3*d*, in which the toner image is fixed to the sheet S by the heat and pressure applied to the sheet S and the toner image thereon, by the fixing portion 3*d*. After the fixation of the toner image to the sheet S, the pair of discharge rollers 4 discharges the sheet S out of the main assembly 1*a*, into the sheet delivery portion 16, which is a part of the top wall of the main assembly 1*a* (casing) of the printer 1, in such a manner that it is deposited in the sheet delivery portion 16, with the surface of the sheet S, which is bearing the toner image, facing downward.

Figure 2:
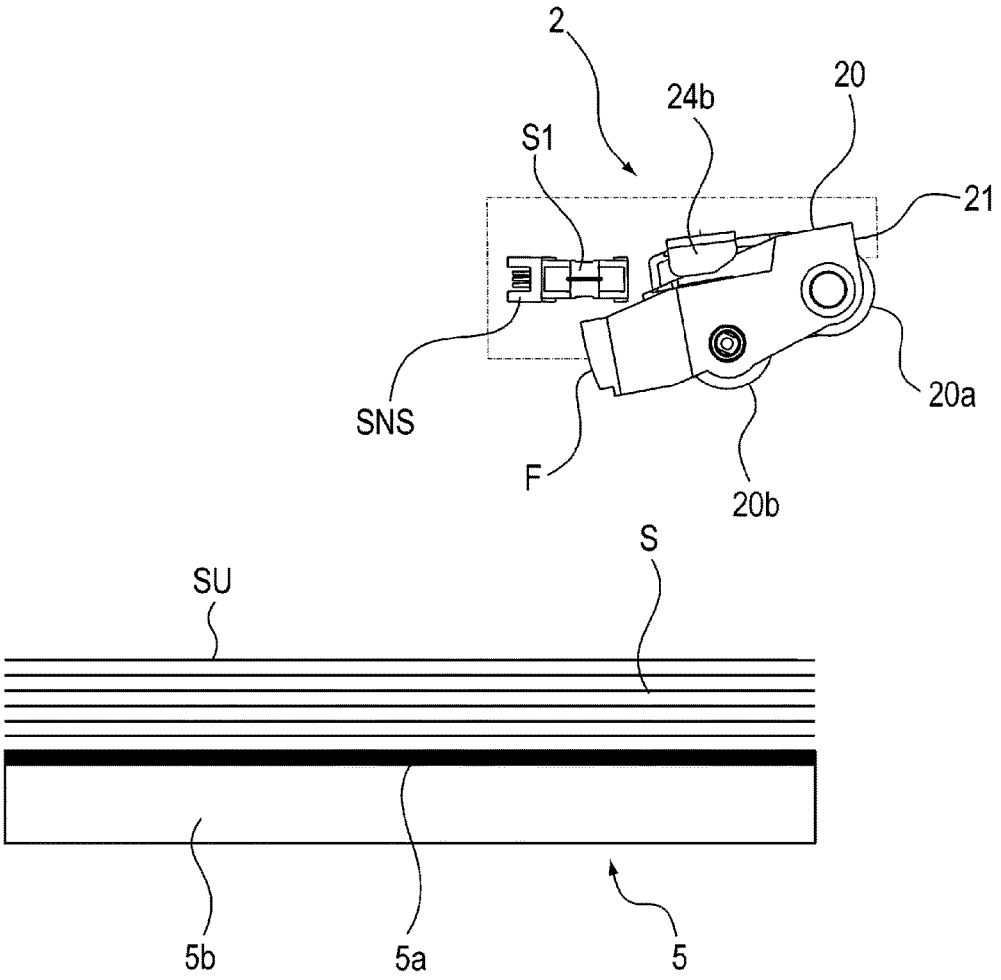
FIG. 2 is a schematic sectional view of a combination of the sheet feeding apparatus, and the sheet storing portion of the sheet feeding apparatus, in the first embodiment. It shows the structure of the sheet feeding apparatus, and that of the sheet storing portion.
Figure 3:
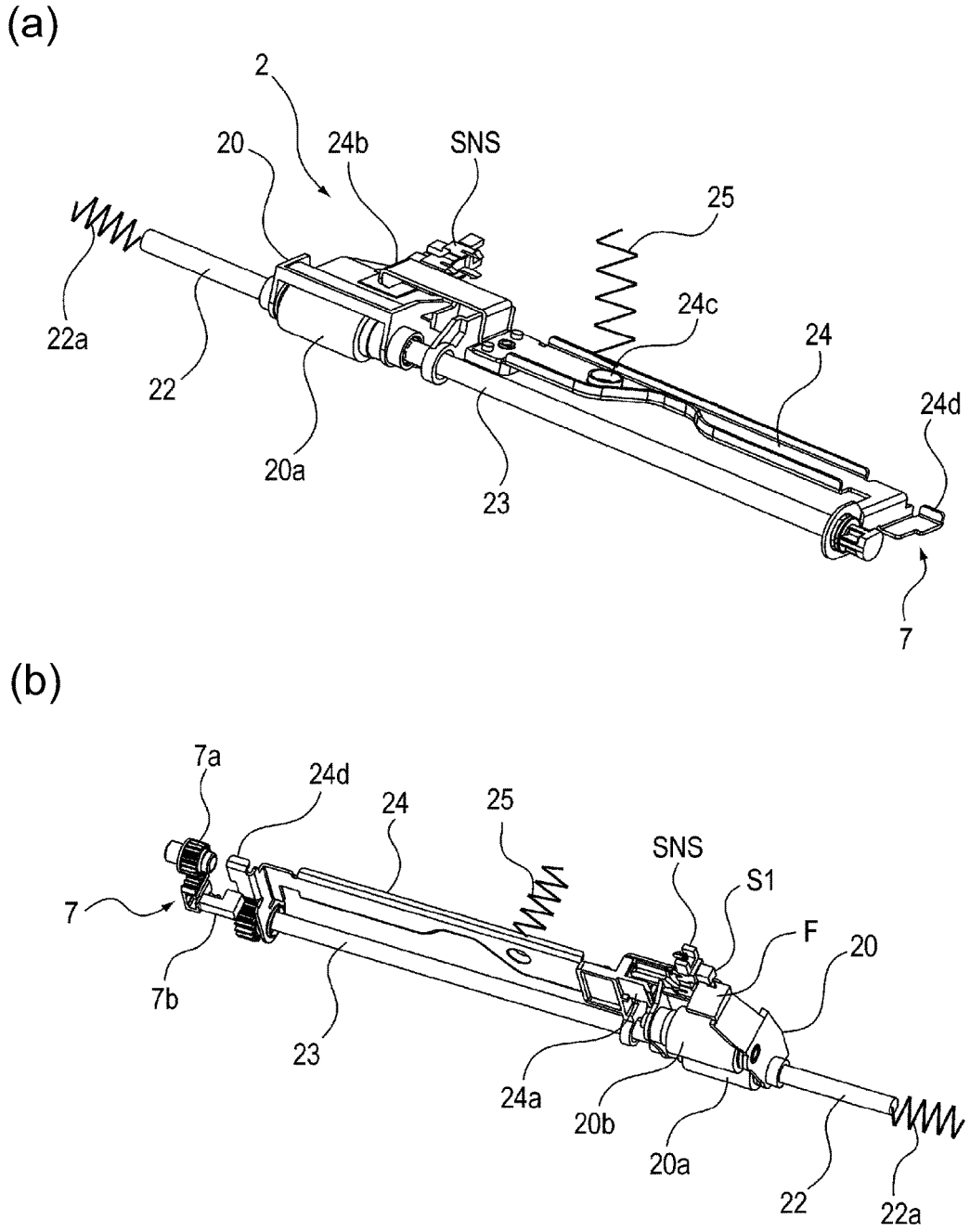
FIG. 3 is a schematic perspective view of the sheet feeding-conveying portion of the sheet feeding apparatus in the first embodiment. It shows the structure of the sheet feeding-conveying portion.

Next, referring to FIGS. 2 and 3, the sheet feeding-conveying portion 2 and sheet storing portion 5 in this embodiment are described in detail. By the way, FIG. 2 is a combination of a side view of the sheet feeding-conveying portion 2 and a vertical sectional view of the sheet storing portion 5. It is for showing the structure of the combination. FIG. 3 is a combination of a perspective view (3*a*) of the sheet feeding-conveying portion 2 in this embodiment, as seen from the top side, and a perspective view (3*b*) of the sheet feeding-conveying portion 2, as seen from the bottom side of the portion 2. It is for showing the structure of the sheet feeding-conveying portion 2.

Referring to FIGS. 2 and 3, the sheet storing portion 5 has: a vertically movable sheet tray 5*a* in which multiple sheets S of recording medium can be loaded in layers; and a tray raising portion 5*b* for raising the sheet tray 5*a*. The sheet tray 5*a* is raised by a mechanical power source M1, such as a motor, with which the sheet tray raising portion 5*b* is provided, and which is under the control of the control portion 10. The sheet tray raising portion 5*b* may be structured as follows, for example: the sheet tray 5*a* is supported in such a manner that it can be vertically moved while remaining horizontal. It is connected to a piece of wire attached to a pulley which is rotatable by a mechanical power source M1 (FIG. 5) such as a motor, so that the wire can be wound up or unwound to move the sheet tray 5*a* up or down. By the way, the sheet tray raising portion 5*a* may be structured as follows: The sheet tray 5*a* is rotatably supported so that it can be rotated upward by a tray lifting member which pushes the bottom surface of the sheet tray 5*a* upward by being rotated by the power source M1.

The sheet tray 5*a* is raised in response to the signals from the sheet surface detection sensor SNS. The relationship between the control of the tray raising operation and the status of the sensor will be described later in detail.

The sheet surface detection sensor SNS is a photo-interrupter. It is attached to an unshown frame. It has a light emitting portion and a light catching portion (which is referred to as detecting portion S1, hereafter). It remains in one of the two states, that is, "interrupted state" and "uninterrupted state". It is disposed so that the sheet surface detection flag F (interrupting member), with which the holding member 20 is provided, is allowed to move between the light emitting portion and light catching portion of the sheet surface detection sensor SNS. Thus, whether the sheet surface detection sensor SNS is in the uninterrupted state or interrupted state is determined by the position of the sheet surface detection flag F.

The sheet feeding-conveying portion 2 has a holder supporting portion 21 for removably supporting the holding member 20. The holder supporting portion 21 is disposed above the sheet tray 5*a*. It holds a combination of a pickup roller 20*b* and feed roller 20*a*, as a sheet feeding-conveying member, for feeding and supplying a sheet S of recording medium downstream in terms of the sheet conveyance direction. The holder supporting portion 21 is provided with a combination of a slidably movable shaft 22 and a drive shaft 23, which are concentrically aligned with each other in a straight line. The slidable shaft 22 is slidable relative to the drive shaft 23 in the direction parallel to its axial line. It is under the pressure generated by a slide spring 22*a* in the direction to press the slidable shaft 22 toward the drive shaft 23. The slidable shaft 22 is fitted in one end of the shaft portion of the feed roller 20*a*, whereas the drive shaft 23 is fitted in the other end of the shaft portion of the feed roller 20*a*. They support the holding member 20 with the presence of the feed roller 20*a* between the slidable shaft 22 and holding member 20, and between the drive shaft 23 and holding member 20. Thus, the holding member 20 can be removed by separating the slidable shaft 22 from the feed roller 20*a* by sliding the slidable shaft 22 in the direction to separate the slidable shaft 22 from the feed roller 20*a*, against the resiliency of the slide spring 22*a*. With the slidable shaft 22 being separated from the holding member 20, the holding member 20 can be separated from the drive shaft 23. The holding member 20 can be attached to the holder supporting portion 21 by carrying out the above-described steps in reverse. With the holding member 20 removed, it is possible to remove the worn or damaged pickup roller 20*b* and feed roller 20*a* from the holding member 20 to replace them. By the way, instead of replacing only the rollers 20*b* and 20*a* by removing them from the holding member 20, the holding member 20 may be replaced together with the two rollers 20*b* and 20*a*.

The holding member 20 is provided with an unshown driving force transmission gear train for transmitting the rotation of the feed roller 20*a* to the pickup roller 20*b*. To the drive shaft 23, which is a part of the holder supporting portion 21, driving force is transmitted from a mechanical power source M3 (FIG. 5) such as a motor. That is, the driving force from the mechanical power source M3 is transmitted to the feed roller 20*a* by way of the drive shaft 23, and then, is transmitted to the pickup roller 20*b* by way of the driving force transmission gear train. Thus, it is possible to rotate the feed roller 20*a* and pickup roller 20*b* to feed and convey a sheet S of recording medium into the main assembly 1*a* of the printer 1. By the way, in order to separate a sheet S of recording medium from the rest while the sheet S is fed into the main assembly 1*a*, the sheet feeding-conveying portion 2 is provided with a separation roller 20*c* (FIG. 1), which is kept pressed upon the feed roller 20*a*. The sheet feeding-conveying portion 2 is structured so that the holding member 20 is rotatable about the shaft portion of the feed roller 20*a*, which is in connection to the slidable shaft 22 (movable shaft) and drive shaft 23, making it possible for the pickup roller 20*b* to be pivotally moved upward or downward. The pickup roller 20*b* is disposed so that it can feed a sheet S of recording medium into the main assembly 1*a* of the printer 1, and convey the sheet S further into the main assembly 1*a*, by coming into contact with the top surface SU of the topmost sheet S of recording medium in the sheet tray 5*a*.

The sheet surface detection flag F is attached to the holding member 20. Thus, it is pivotally moved by the pivotal movement of the holding member 20. Further, it is disposed so that the sheet surface detection sensor SNS is put into the "uninterrupted state" or "interrupted state" depending on where the holding member 20 is in its moving range.

Next, referring to FIG. 3, the sheet feeding-conveying portion 2 is provided with a pick-up pressure plate 24 which is pivotally movable about the drive shaft 23. The pick-up pressure plate 24 has a holder raising and lowering portion 24*a* and a holder pressing portion 24*b*, which are disposed in a manner to sandwich the holding member 20 from the top and bottom sides, respectively. The sheet feeding-conveying portion 2 is structured so that when either the holder raising and lowering portion 24*a* or holder pressing portion 24*b* is in contact with the holding member 20, the other does not contact the holding member 20. One end of a pickup spring 25 is fixed to the unshown frame, and the other end is fixed to the spring seating portion 24*c* of the pick-up pressure plate 24. The pickup spring 25 keeps the holding member 20 pressed toward the sheets S of recording medium in the sheet tray 5*a*, with the presence of the holder pressing portion 24*b* between the spring 25 and holding member 20.

Next, referring to FIG. 4, the pivotal upward and downward movements of the holding member 20 are described. Part (a) of FIGS. 4, 4(*b*) and 4(*c*) show the states in which the holding member 20 is while the holding member 20 is pivotally moved upward or downward.

Referring to part (b) of FIG. 3, the pick-up device raising portion 7 (raising-lowering unit) has: a mechanical driving force source M2 (FIG. 5), such as a motor, which can be reversed in rotation; a pick-up device raising gear 7*a* which rotates by being driven by the power source M2; and a pick-up device raising member 7*b* which is rotated by the rotation of the pick-up device raising gear 7*a*. The pick-up device raising member 7*b* is in the shape of a letter L. It is disposed so that it can press the lengthwise end 24*d* of the pick-up pressure plate 24 from the bottom side of the pick-up pressure plate 24. As driving force is transmitted from the mechanical power source M2 to the pick-up pressing member 7*b* by way of the pick-up raising gear 7*a*, the pick-up device raising member 7*b* is rotated by the transmitted driving force. As it is rotated, it presses the lengthwise end portion 24*d* (portion to be pressed) of the pick-up pressure plate 24, causing thereby the pick-up pressure plate 24 to pivotally move. That is, as the control portion 10 causes the power source M2 to rotate in one direction (forward, for example), the L-shaped portion of the pick-up device raising member 7*b* is rotated in the direction to downwardly separate from the lengthwise end 24*d* (portion to be pressed) of the pick-up pressure plate 24. On the other hand, as the control portion 10 causes the power source M2 to rotate in the other direction (backward, for example) the pick-up device raising member 7*b* is rotated in such a direction that the L-shaped portion of the pick-up device raising member 7*b* moves the lengthwise end 24*d* of the sheet pressing member 24 upward.

Thus, as the control portion 10 causes the power source M2 to rotate backward to move the pick-up device raising member 7*b* upward, the L-shaped portion of the pick-up device raising member 7*b* pushes the lengthwise end 24*d* of the pick-up pressure plate 24. Thus, the pick-up pressure plate 24 is pivotally moved upward against the resiliency of the pick-up spring 25. As the pick-up pressure plate 24 is made to upwardly pivot, the holder raising and lowering portion 24*a* comes into contact with the holding member 20, and causes the holding member 20 to upwardly pivot (state shown in part (a) of FIG. 4).

Further, as the control portion 10 causes the power source M2 to rotate forward, the pick-up device raising member 7*b* is downwardly moved. Thus, the pick-up pressure plate 24 is made to downwardly pivot by the resiliency of the pick-up spring 25. As the pick-up pressure plate 24 is made to downwardly pivot, the holding member 20 is made to downwardly pivot by being pressed by the holder pressing portion 24*b* (state shown in part (b) of FIG. 4).

That is, as the control portion 10 causes the power source M2 to rotate backward, the pick-up pressure plate 24 is pivotally moved by the pick-up device raising member 7*b*. As a result, the holding member 20 is pivotally moved upward (raised). On the other hand, as the control portion 10 causes the power source M2 to rotate forward, the pick-up pressure plate 24 is pivotally moved downward by the pick-up device raising member 7*b*. As a result, the holding member 20 is made to downwardly pivot. In other words, the pick-up device raising portion 7 can be pivotally moved upward and downward by the forward and backward rotation, respectively, of the power source M2.

Next, the relationship between the state of the sheet surface detection sensor SNS and the position of the holding member 20 is described.

Referring to part (a) of FIG. 4, when the holding member 20 is in its highest angle into which it was pivotally moved by the pick-up device raising portion 7, the sheet surface detection sensor SNS is in the interrupted state; the beam of light is interrupted by the sheet surface detection flag F. On the other hand, referring to part (b) of FIG. 4, when the holding member 20 is in the lowest angle into which it was pivotally moved by the pick-up device raising portion 7, the sheet surface detection flag F is in its bottom most position, and therefore, the sheet surface detection sensor SNS is in the uninterrupted state.

If the sheet tray 5*a* is raised by the tray raising portion 5*a* while the holding member 20 is in its lowest angle, the top surface SU of the topmost sheet S of recording medium on the sheet tray 5*a* comes into contact with the pickup roller 20*b*, and then, causes the holding member 20 to upwardly pivot. As the holding member 20 upwardly pivots, it separates from the holder raising and lowering portion 24*a*, and then, comes into contact with the holder pressing portion 24*b*. As the holding member 20 comes into contact with the holder pressing portion 24*b*, it upwardly pivots with the pick-up pressure plate 24 against the force generated by the resiliency of the pick-up spring 25. As the holding member 20 pivotally moves upward, the sheet surface detection flag F blocks the detecting portion S1 of the sheet surface detection sensor SNS from the light emitting portion of the sheet surface detection sensor SNS. Consequently, the sheet surface detection sensor SNS is put in the interrupted state. At this point in time, the top surface of the topmost sheet S on the sheet tray 5*a* is in the position which is proper for the pickup roller 20*b* to feed the topmost sheet S into the main assembly 1*a* of the printer 1, and into which it was moved by the upward movement of the sheet tray 5*a* (part (c) of FIG. 4).

Next, the relationship between the state of the sheet surface detection sensor SNS and the upward or downward movement of the sheet tray raising (lowering) portion 5*b* is described.

Ordinarily, as the printer 1 is turned on, the sheet feeding-conveying portion 2 is initialized. More specifically, in order to make it possible for a sheet S of recording medium to be fed into the main assembly 1*a* of the printer 1 from the sheet tray 5*a*, the sheet tray 5*a* is raised by the tray raising portion 5*b* so that the top surface SU of the topmost sheet S of recording medium on the sheet tray 5*a* is placed in the preset sheet feeding-conveying position. Then, as it becomes possible for the pickup roller 20*b* to feed the sheet S into the main assembly 1*a*, the pickup roller 20*b* begins to be rotated in response to a sheet feeding start signal to feed the topmost sheet S from the sheet tray 5*a* into the main assembly 1*a*.

Before the sheet tray 5*a* begins to be raised, that is, before this sheet feeding-conveying operation is started, it is detected whether or not the removably installable holding member 20 is properly attached to the sheet feeding-conveying portion 2. That is, before the control portion 10 begins to raise the sheet tray 5*a*, it drives the power source M2 to causes the pick-up device raising member 7*b* to make the holding member to upwardly pivot, and then, downwardly pivot. In other words, it causes the power source M2 to rotate in one direction (forward, for example) and then, in reverse (backward, for example) to make the pick-up device raising member 7*b* come into contact with the lengthwise end portion 24*d* (portion to be pressed) of the pick-up pressing plate 24, presses the lengthwise end 24*d*, and then, separate from the lengthwise end 24*d*. Thus, the holding member 20 is pivotally moved downward, pivotally moved upward, and then, pivotally moved downward, by the pick-up pressure plate 24. As the holding member 20 is pivotally moved as described above, the sheet surface detection sensor SNS is placed in the state of being uninterrupted, and then, in the state of being interrupted. Finally, it is placed in the state of being uninterrupted. As these changes in the state of the sheet surface detection sensor SNS is detected by the control portion 10, the control portion 10 determines that the holding member 20 is properly attached. That is, the control portion 10 causes the holding member 20 to pivot upwardly, and then, downwardly, before it starts a sheet feeding-conveying operation. Then, if the signals from the sheet surface detection sensor SNS change as described above, as the power source M2 is driven as described above, it determines that the holding member 20 is properly installed in the sheet feeding-conveying portion 2.

After the control portion 10 determines that the holding member 20 is normally installed, it drives the power source M2 in the direction to make the holding member 20 to downwardly pivot. Then, the control portion 10 drives the power source M1 to causes the sheet tray raising portion 5*b* to raise the sheet tray 5*a* (initial raising). As the sheet tray 5*a* is raised by the driving of the power source M1, the top surface of the topmost sheet S of recording medium in the sheet tray 5*a* comes into contact with the pickup roller 20*b*, and causes the holding member 20, which is rotatably holding pickup roller 20*b*, to upwardly pivot as described above. As the holding member 20 upwardly pivots, the sheet surface detection flag F of the holding member 20 moves upward with the holding member 20, blocking thereby the beam of light emitted by the light emitting portion of the sheet surface detection sensor SNS. Thus, the sheet surface detection sensor SNS is put in the interrupted state. As the control portion 10 detects that the state of the sheet surface detection sensor SNS changed to the interrupted state, it stops driving the power source M1, ending thereby the operation which is to be carried out to raise the sheet tray 5*a*, and allows the holding member 20 to downwardly pivot, before it begins the sheet feeding-conveying operation. Then, it starts sheet feeding-conveying operation.

During the sheet feeding-conveying operation, the sheets S of recording medium stacked in the sheet tray 5*a* are sequentially fed into the main assembly 1*a* of the printer 1, and conveyed further into the main assembly 1*a*, by the rotational driving of the feed roller 20*a*. As the sheets S in the sheet tray 5*a* are gradually reduced in number by the sheet feeding-conveying operation, the position of the top surface SU of the topmost sheet S of recording medium gradually lowers, allowing the holding member 20 to gradually pivot downwardly. Eventually, the state of (signals from) the sheet surface detection sensor SNS changes to the uninterrupted state. As the state of the sheet surface detection sensor SNS changes to the uninterrupted one, the control portion 10 causes the sheet tray raising portion 5*b* to raise the sheet tray 5*a* again, by driving the power source M1, until the top surface SU of the topmost sheet S in the sheet tray 5*a* puts the sheet surface detection sensor SNS in the interrupted state. By carrying out this control sequence, it is possible to move the top surface SU of the topmost sheet S in the sheet tray 5*a* into the position which is proper for the sheet feeding-conveying operation. By the repetition of this control sequence, it is possible to feed a sheet S of recording medium into the main assembly 1*a* of the printer 1, and convey the sheet S further into the main assembly 1*a*, until the sheet tray 5*a* runs out of the sheet S. As the sheet tray 5*a* runs out of the sheet S, the sheet presence (absence) detection sensor SNS detects the absence of the sheet S, and informs a user of the absence of the sheet S through the monitor, with which the printer 1 is provided, and/or the monitor of the personal computer which is in connection to the printer 1.

However, it sometimes occurs that even if the power source M2 is driven to make the pick-up device raising member 7*b* pivot in a manner to separate from the lengthwise end 24*d* of the pick-up pressure plate, 24, press the portion 24*d*, and then, separate again from the lengthwise end 24*d*, prior to the initial raising of the sheet tray 5*a*, the sheet surface detection sensor SNS remains stuck in the interrupted state. In such cases, the control portion 10 detects no change in the state of the sheet surface detection sensor SNS. Thus, it determines that the sheet feeding-conveying portion 2 is not fitted with the holding member 20 at all, or is improperly fitted with the holding member 20 (holding member 20 is abnormally attached). Then, it displays the information about the anomaly in the attachment of the holding member 20, on the monitor of the printer 1, and/or the monitor of the personal computer which is in connection to the printer 1. In other words, it is possible to detect the anomaly in the attachment of the holding member 20, before the tray raising portion 5*b* begins to raise the sheet tray 5*a*. Therefore, it is possible to prevent such a problem that the apparatus is damaged because the sheet tray 5*a* is raised without the presence of the holding member 20.

As described above, according to this embodiment, it is possible to detect that the holding member 20 is not properly installed, before the sheet feeding-conveying operation by the sheet feeding-conveying portion 2 is started. Therefore, it is possible to prevent the occurrence of such inconveniences that the structural members of the printer 1, which will be in the adjacencies of the holding member 20 if the holding member 20 is properly installed, are damaged, and/or the message which indicates the occurrence of a paper jam, or a sheet conveyance error, is unnecessarily displayed.

[Embodiment 2]

Next, an image forming apparatus equipped with the sheet feeding apparatus in the second embodiment of the present invention is described with reference to the appended drawings. The second embodiment is different from the first one in the range of the pivotal movement of the holding member 20, and therefore, in the positional relationship between the holding member 20 and sheet surface detection sensor SNS. Thus, the members of the image forming apparatus in this embodiment, which are the same in structure as the counterparts in the first embodiment, are not shown, or given the same referential codes as those given to the counterparts and are not described.

Referring to FIG. 6, the processes of causing the holding member 20 of the sheet feeding-conveying portion 2 in the second embodiment to upwardly or downwardly pivot are described. Part (a) of FIGS. 6, 6(*b*) and 6(*c*) are for showing the states in which the holding member 20 of the sheet feeding-conveying portion 2 are put when the holding member 20 is made to upwardly or downwardly pivot.

The holding member 20 holds a combination of the pickup roller 20*b* and feed roller 20*a*, which is for feeding a sheet S of recording medium into the main assembly 1*a* of the printer 1, and supplying the sheet S downstream in terms of the sheet conveyance direction, as in the first embodiment. The holder supporting portion 21 has: a slidable shaft 22 which is kept pressured by the slide spring 22*a*; and a drive shaft 23. It pivotally supports the holding member 20 (FIG. 3). A part of the holding member 20 is provided with a sheet surface detection flag F (detectable member) which is for blocking the detecting portion S1 of the sheet surface detection sensor SNS from the beam of light emitted by the light emitting portion of the sensor SNS.

Next, the relationship between the state of the sheet surface detection sensor SNS and the position of the holding member 20 is described.

Referring to part (a) of FIG. 6, when the holding member 20 in its highest angle into which it can be made to pivot by the pick-up device raising member 7, the sheet surface detection flag F of the holding member 20 is positioned higher than the detecting portion S1 of the sheet surface detection sensor SNS. When the holding member 20 is in this angle as shown in part (a) of FIG. 6, the state of (signals from) the sheet surface detection sensor SNS is being uninterrupted. In comparison, when the holding member 20 is in the lowest angle into which it was made to downwardly pivot by the pick-up device raising member 7, the sheet surface detection flag F is in the position into which it was moved by the pivotal movement of the holding member 20. Thus, it is positioned lower than the detecting portion S1 of the sheet surface detection sensor SNS. When the flag F is in this position, the state of (signals from) the sheet surface detection sensor SNS is being uninterrupted.

If the sheet tray 5*a* is raised by the upward movement of the tray raising portion 5*b* while the holding member 20 is in the lowest angle, the top surface SU of the topmost sheet S of recording medium in the sheet tray 5*a* comes into contact with the pickup roller 20*b*, and then, causes the holding member 20 to upwardly pivot. As the holding member 20 upwardly pivots, it separates from the holder raising and lowering portion 24*a*, and comes into contact with the holder pressing portion 24*b*. As the holding member 20 comes into contact with the holder pressing portion 24*b*, it upwardly pivots with the pick-up pressure plate 24 against the pressure generated by the pick-up spring 25. As the holding member 20 pivots upward, the sheet surface detection flag F blocks the detecting portion S1 of the sheet surface detection sensor SNS. That is, the sheet surface detection sensor SNS is put in the state of being interrupted. By the time the sheet surface detection sensor SNS is put in the state of being interrupted, the holding member 20 will have been made to pivot into the proper angle for positioning the top surface of the topmost sheet S in the sheet tray 5*a* for the pickup roller 20*b* to feed the sheet S into the main assembly 1*a* (part (c) of FIG. 6).

Next, the relationship between the state of the small diameter section 52*c* and the operation of the sheet tray raising portion 5*b* is described.

Ordinarily, also in this embodiment, as the printer 1 is activated, the control portion 10 causes the tray raising portion 5*b* to rise so that the top surface of the topmost sheet S of recording medium in the sheet tray 5*a* is placed in a preset position for feeding the sheet S into the main assembly 1*a*.

Before the sheet tray 5*a* is raised for the first time after the printer 1 is activated, that is, before the sheet feeding-conveying operation is started, the control portion 10 determines whether or not the removably installable holding member 20 is properly attached to the sheet feeding-conveying portion 2. That is, before the control portion 10 causes the tray raising portion 5*b* to raise the sheet tray 5*a* for the first time after the activation of the printer 1, it causes the pick-up device raising member 7 to cause the holding member 20 to pivot upward, and then, downward to detect whether the holding member 20 is present or not, based on the signals from the sheet surface detection sensor SNS sent during the above-described operation. More specifically, first, the control portion 10 drives the power source M2 to causes the pick-up device raising member 7*b* to cause the holding member 20 to upwardly pivot and then, downwardly. In this embodiment, the control portion 10 causes the power source M2 to rotate in one direction (forward, for example), and then, in the other direction (backward, for example) in order to make the pick-up device raising portion 7 pivot in such a manner that first, it presses the lengthwise end portion 24*d* (portion to be pressed), and then, separates from the lengthwise end portion 24*d*. As the pick-up device raising portion 7 presses on the portion 24*d*, and then, separates from the portion 24*d*, the holding member 20 is made to upwardly pivot by the pick-up pressure plate 24, and then, downwardly. Thus, the holding member 20 is changed in angle from the highest one (part (a) of FIG. 6) to the lowest one (part (b) of FIG. 6). While the holding member 20 changes in angle, the sheet surface detection flag F passes between the detecting portion S1 and light emitting portion of the sheet surface detection sensor SNS. Thus, the state of (signals from) the sheet surface detection sensor SNS changes from being uninterrupted to being interrupted, and then, back to being uninterrupted. As the control portion 10 detects these changes in the state of the sheet surface detection sensor SNS, it determines that the holding member 20 is properly installed. That is, the control portion 10 causes the holding member 20 to upwardly pivot, and then, downwardly, before it starts the sheet feeding-conveying operation. If the signals sent from the sheet surface detection sensor SNS to the control portion 10 change in state as the holding member 20 is made to upwardly pivot, and then, downwardly pivot, the control portion 10 determines that the holding member 20 is properly installed.

The operational sequence to be carried out after the holding member 20 is made to upwardly pivot for the first time after it was detected that the holding member 20 is normally installed is the same as the one in the first embodiment. Therefore, it is not described.

On the other hand, there occurs sometimes that even if the power source M2 is driven to causes the pick-up device raising portion 7 to press the end portion 24*d* of the pick-up pressure plate 24, and then, separate from the end portion 24*d*, before the sheet tray 5*a* is raised for the first time after the printer 1 is activated, the state of (signals from) the sheet surface detection sensor SNS remains being uninterrupted. In such cases, as the control portion 10 detects no change in the state of the sheet surface detection sensor SNS, it determines that the holding member 20 is not present in the sheet feeding-conveying portion 2, or is not properly installed, that is, the installation of the holding member 20 is abnormal. In other words, it can be detected, before the sheet tray 5*a* is raised for the first time after the printer 1 is activated, that the holding member 20 is abnormally attached. Therefore, it is possible to prevent the problem that the apparatus is damaged because the sheet tray 5*a* is raised when the holding member 20 is not in the sheet feeding-conveying portion 2.

As described above, also in this embodiment, it can be detected, before the sheet feeding-conveying portion 2 begins the sheet feeding-conveying operation, that the installation of the holding member 20 is improper. Therefore, it is possible to prevent the problem that the structural members, which will be in the adjacencies of the holding member 20 if the holding member 20 is properly installed, are damaged, and/or such an inconvenience that a message which indicates the occurrence of the paper jam or the like is displayed. However, this embodiment is different from the first embodiment in the positional relationship between the sheet surface detection sensor SNS and holding member 20. Thus, this embodiment is simpler, and shorter, in the operation to move the pick-up device raising portion 7 before the sheet tray 5*a* is raised for the first time after the activation of the printer 1. That is, the second embodiment is smaller in the number of operational steps, and shorter in the length of the preparatory operation, than the first embodiment. That is, this embodiment is shorter than the first embodiment in the length of time required to determine whether or not the holding member 20 is in the sheet feeding-conveying portion 2, or whether or not the holding member 20 is properly installed. Thus, this embodiment is shorter than the first embodiment in the length time it takes to start the sheet feeding-conveying operation after the activation of the printer 1, being therefore superior in usability than the first embodiment.

[Others]

In the foregoing, the first and second preferred embodiments of the present invention were described. However, these embodiments are not intended to limit the present invention in scope. Further, the effects of the present invention described in the foregoing are no more than a listing of a few of the most preferable ones. That is, the effects of the present invention are not limited to the above-described ones. By the way, the first and second embodiments may be utilized in combination.

For example, the motors employed as the power sources M1, M2 and M3, with which the sheet feeding-conveying portion 2, sheet storing portion 5, and pick-up device raising portion 7, respectively, may be replaced by such actuators as solenoids. Further, instead of providing each of the sheet feeding-conveying portions 2, sheet storing portion 5, and pick-up device raising portion 7 with a dedicated power source, the printer 1 may be structured so that one or two power source can be shared by the three portions 2, 5 and 7, with the employment of clutches or the like.

Further, in the first and second embodiments of the present invention described above, the image forming apparatus was a printer having an image forming portion which carries out an electrophotographic image formation process. However, the two embodiments are not intended to limit the present invention in scope. That is, the present invention is also compatible with an inkjet printer, that is, a printer having an image forming portion which forms an image by jetting liquid ink from its nozzles.

Further, the first and second embodiments were described with reference to a printer having an image forming portion for carrying out an electrophotographic image forming process. However, these embodiments are not intended to limit the present invention in terms of the type of image forming apparatus to which the present invention is compatible. That is, the present invention is also compatible with other image forming apparatuses than a printing machine. For example, the present invention is also compatible with a copying machine, a facsimileing machine, and a multifunction machine having a combination of the functions of the preceding machines. By applying the prevent invention to the sheet feeding-conveying portion (sheet feeding apparatus) of any of these image forming apparatuses can provide the effects similar to the above-described ones.

Moreover, in the embodiments described above, the sheet feeding apparatus was an integral part of the image forming apparatus. However, these embodiments are not intended to limit the present invention in scope. For example, the present invention is also compatible with a sheet feeding apparatus which is removably installable in the main assembly of an image forming apparatus. The effects obtainable by applying the present invention to such a sheet feeding apparatus are similar to those described above.

Further, in the embodiments described above, the sheet feeding apparatus was for feeding and supplying a sheet of recording paper, on which an image is recorded. However, these embodiments are not intended to limit the present invention in scope. For example, the present invention is also applicable to a sheet feeding apparatus for feeding and supplying sheets of recording medium (paper) which bear original images to be read. The application of the present invention to such an apparatus can provide effects similar to those described above.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-029612 filed on Feb. 21, 2017, which is hereby incorporated by reference herein in its entirety.

What is claimed is:

1. A sheet feeding device comprising:

a stacking unit configured to stack a sheet;

a feeding member including (a) a rotatable feeding roller configured to feed the sheet having been stacked on said stacking unit and (b) a supplying roller configured to supply the sheet fed by said feeding roller;

a holding member holding said feeding member;

a holder supporting portion provided above said stacking unit and configured to detachably support said holding member;

a raising and lowering unit configured to raise and lower said holding member;

a detecting unit having a detection state that is changed by movement of said holding member; and a control unit capable of operating said raising and lowering unit to raise and lower said holding member in a state that said holding member is not mounted to said holder supporting portion, wherein, when the detection state changes from a first state to a second state, said control unit discriminates that said holding member is mounted to said holder supporting portion, wherein, when the first detection state of said detecting unit is maintained, despite the movement of said raising and lowering unit, said control unit discriminates that said holding member is not mounted to said holder supporting portion, wherein said holder supporting portion includes (a) a driving shaft configured to rotate said supplying roller and (b) a movable shaft movable in an axial direction of said driving shaft, and wherein said holding member is supported by said holder supporting portion by the engagement between said driving shaft and said movable shaft.

2. A device according to claim 1, wherein said holding member includes a member-to-be-detected that is rotatable with a rotation of said holding member and configured to switch the signal of said detecting unit.

3. A device according to claim 1, wherein said control unit at least raises and lowers said holding member using said raising and lowering unit before a feeding operation of said feeding member, and detects presence or absence of said holding member on the basis of a signal from said detecting unit produced with the raising and lowering operation.

4. A device according to claim 1, wherein said holding member is lowered by rotating said driving shaft in a first direction, and said holding member is raised by rotating said driving shaft in a second direction opposite to the first direction.

5. A device according to claim 4, wherein said control unit effects an operation of rotating said driving shaft in the first direction and the second direction, and wherein, when a change of the signal from said detecting unit with the driving shaft rotating operation is detected, presence of said holding member is discriminated, and when the change is not detected, absence of said holding member is discriminated.

6. An image forming apparatus comprising:

a stacking unit configured to stack a sheet;

a feeding member including (a) a rotatable feeding roller configured to feed the sheet having been stacked on said stacking unit and (b) a supplying roller configured to supply the sheet fed by said feeding roller;

an image forming station configured to form an image on the sheet supplied by said feeding member;

a holding member holding said feeding member;

a holder supporting portion provided above said stacking unit and configured to detachably support said holding member;

a raising and lowering unit configured to raise and lower said holding member;

a detecting unit having a detection state that is changed by movement of said holding member; and a control unit capable of operating said raising and lowering unit to raise and lower said holding member in a state that said holding member is not mounted to said holder supporting portion, wherein, when the detection state changes from a first state to a second state, said control unit discriminates that said holding member is mounted to said holder supporting portion, wherein, when the first detection state of said detecting unit is maintained, despite the movement of said raising and lowering unit, said control unit discriminates that said holding member is not mounted to said holder supporting portion, wherein said holder supporting portion includes (a) a driving shaft configured to rotate said supplying roller and (b) a movable shaft movable in an axial direction of said driving shaft, and wherein said holding member is supported by said holder supporting portion by the engagement between said driving shaft and said movable shaft.

7. An apparatus according to claim 6, wherein said holding member includes a member-to-be-detected that is rotatable with a rotation of said holding member and configured to switch the signal of said detecting unit.

8. An apparatus according to claim 6, wherein said control unit effects an operation of raising and lowering said holding member before a feeding operation of said feeding member, and wherein, when a change in a signal from said detecting unit with the operation is detected, presence of said holding member is discriminated, and when the change is not detected, absence of said holding member is discriminated.

* * * * *